US009520117B2

(12) United States Patent
Dourmashkin et al.

(10) Patent No.: US 9,520,117 B2
(45) Date of Patent: Dec. 13, 2016

(54) OPTICAL ELECTRONIC MUSICAL INSTRUMENT

(71) Applicant: SPECDRUMS, INC., Ithaca, NY (US)

(72) Inventors: Steven Dourmashkin, Locust Valley, NY (US); Matthew Skeels, Stanwood, WA (US)

(73) Assignee: SPECDRUMS, INC., Ithaca, NY (US)

( * ) Notice: Subject to any disclaimer, the term of this patent is extended or adjusted under 35 U.S.C. 154(b) by 0 days.

(21) Appl. No.: 15/045,868

(22) Filed: Feb. 17, 2016

(65) Prior Publication Data

US 2016/0247495 A1 Aug. 25, 2016

Related U.S. Application Data

(60) Provisional application No. 62/118,672, filed on Feb. 20, 2015.

(51) Int. Cl.
*G10H 1/06* (2006.01)
*G10H 7/00* (2006.01)
(Continued)

(52) U.S. Cl.
CPC ..... *G10H 1/34* (2013.01); *G10D 13/024* (2013.01); *G10H 2220/185* (2013.01);
(Continued)

(58) Field of Classification Search
CPC ..... G10H 1/34; G10H 2220/185; G10H 2220/441; G10H 2220/331; G10H 2220/395; G10D 13/024
(Continued)

(56) References Cited

U.S. PATENT DOCUMENTS 5,159,140 A * 10/1992 Kimpara ..... G10H 1/00 84/600
5,689,078 A 11/1997 McClard
(Continued)

FOREIGN PATENT DOCUMENTS

WO 2005055893 A1 6/2005

OTHER PUBLICATIONS http://www.wired.com/2014/03/cyborg-neil-harbisson-teaches-musicians-play-color-sheet-music/, Mar. 26, 2014.
(Continued)

*Primary Examiner* — Jeffrey Donels
(74) *Attorney, Agent, or Firm* — Dilworth & Barrese, LLP; Michael J. Musella

(57) ABSTRACT

An optical electronic musical instrument device ("e-instrument") that is configured to identify colors and output sounds that are associated with the identified color is disclosed. The e-instrument may detect colors using a color sensor and generate a color signal as a result. Additionally, the volume of the sound may be influenced by a motion signal generated by a motion sensor, wherein the lower or higher the motion signal's value corresponds to a lower or higher volume. The color and motion signals may be sent to one or more processors, either local or remote from the e-instrument, that generates or retrieves a sound signal based on the color and motion signals. The sound signal may then be transmitted to a speaker and the speaker outputs the sound signal accordingly. The sound signal may be any instrument, including a sound of a guitar, piano, drum, etc.

18 Claims, 10 Drawing Sheets

(51) Int. Cl.
*G10H 1/34* (2006.01)
*G10D 13/02* (2006.01)

(52) U.S. Cl.
CPC . *G10H 2220/331* (2013.01); *G10H 2220/395* (2013.01); *G10H 2220/441* (2013.01)

(58) Field of Classification Search
USPC ..... 84/622
See application file for complete search history.

(56) References Cited

U.S. PATENT DOCUMENTS

| | | | | |
|---|---|---|---|---|
| 6,084,169 | A * | 7/2000 | Hasegawa | G10H 1/0025 84/477 R |
| 6,686,529 | B2 | 2/2004 | Kim | |
| 7,525,034 | B2 | 4/2009 | Nease et al. | |
| 8,017,851 | B2 | 9/2011 | Horovitz et al. | |
| 2004/0222362 | A1 | 11/2004 | Zelenka et al. | |
| 2005/0188821 | A1* | 9/2005 | Yamashita | G10H 1/40 84/611 |
| 2006/0132714 | A1 | 6/2006 | Nease et al. | |
| 2006/0236845 | A1* | 10/2006 | Kilkis | G10H 1/0075 84/600 |
| 2012/0137858 | A1 | 6/2012 | Sakazaki | |
| 2013/0239782 | A1* | 9/2013 | Yoshihama | G10H 7/00 84/609 |

OTHER PUBLICATIONS

Color to Sound Player, Deyu Liu & Kevin Lin, Cornell University, Fall 2012.

* cited by examiner

Color to Sound Association Table

| Color | Sound/Tone | | |
|---|---|---|---|
| | Example 1 | Example 2 | Example 3 |
| Red | C | D | E |
| Green | D | E | F |
| Blue | E | F | G |
| Orange | F | G | A |
| Black | G | A | B |

410

FIGURE 4

OPTICAL ELECTRONIC MUSICAL INSTRUMENT

CROSS-REFERENCE TO RELATED APPLICATIONS

This application claims the benefit of U.S. Provisional Application No. 62/118,672, filed Feb. 20, 2015, the entire disclosure of which is hereby incorporated herein by reference.

BACKGROUND

Musical instruments tend to be expensive and difficult to transport. For example, instruments such as a drum set, piano, and violin typically cost in the hundreds or even thousands of dollars. In addition, once a location is selected for some of these instruments, such as the drum set and piano, a user may find it difficult to use the instrument at another location due to the robust and clunky nature of the instruments. In this regard, if a group of people were to congregate to play music, the instruments may either dictate the location of the event, or the users may have to spend time packing and transporting the instruments. Furthermore, during transportation damage can occur to these expensive products.

SUMMARY

An optical electronic musical instrument device (e-instrument) that is easily transportable and cost-effective to produce and manufacture is disclosed herein. The e-instrument may include a color sensor that is capable of generating a color signal based on a particular color that is placed in close proximity to the color sensor. The e-instrument may further include a motion sensor that generates a motion signal. Based on the color signal and the motion signal, a processor may produce a sound x re-determined by the system or selectable by the user. The color signal may correspond to a particular type of sound, such as instrument or tone, and the motion signal may determine the volume at which the sound signal is output. For instance, the higher the value of the output generated by the motion sensor, the higher the volume of the sound signal, and the lower the value of the output, the lower the volume of the sound signal.

In addition, the motion signal may be used to activate the processor. For example, the e-instrument may include a filter, such as a high-pass filter, that verifies the motion signal was generated based on a legitimate tap by the user and not due to inadvertent movement of the e-instrument. When the filter determines that the motion signal is a result of a legitimate tap by the user, the color sensor is triggered to measure color, and then the color signal and the motion signal are transmitted to the processor for processing. When the filter determines that the motion signal is not a legitimate tap against a surface, the color sensor is thereby not activated and neither the motion signal or a color signal is sent to the processor for processing.

The e-instrument may communicate with a computing device, such as a smart phone, that receives the color signal and motion signal and generates a sound signal based thereon. The smart phone may then output the sound signal using a speaker associated therewith. Alternatively or in addition, the e-instrument may generate the sound signal at a local processor and then transmit the sound signal to a speaker that the local processor is in communication with.

An optical electronic musical instrument is disclosed herein, the optical electronic musical instrument includes a processor; a color sensor connected to the processor and configured to generate a color signal based on a color within close proximity to the color sensor; and a motion sensor connected to the processor and configured to generate a motion signal when the optical electronic musical instrument is moved from a first position to a second position; receive at the processor the color signal and the motion signal; transmit at the processor the color signal and the motion signal to a computing device processor, wherein the computing device processor is associated with a computing device; generate or retrieve at the computing device processor a sound signal based on the color signal and the motion signal.

A method is also disclosed herein, the method comprising the steps of generating by a motion sensor a motion signal when an optical electronic musical instrument is moved from a first position to a second position; generating by a color sensor a color signal based on a color within close proximity to the color sensor; receiving the color signal and the motion signal at a processor; and generating or receiving by the processor a sound signal based on the color signal and motion signal.

Another system is disclosed herein, the system comprising one or more processors; one or more sensors operatively coupled to the one or more processors; and memory operatively coupled to the one or more processors, wherein the one or more processors are configured to: associate a plurality of colors with a plurality of sounds, wherein each one of the plurality of colors is associated with one of the plurality of sounds; identify by the one or more sensors a color on a surface; determine by the one or more processors a sound of the plurality of sounds that is associated with the color; receive by one or more speakers the sound from the one or more processors; and output by the one or more speakers an auditory sound based on the sound.

BRIEF DESCRIPTION OF THE DRAWINGS

FIG. 4 is a table that illustrates multiple examples of different sounds being associated with individual colors in accordance with aspects of the present disclosure;

Like reference numerals indicate similar parts throughout the figures.

DETAILED DESCRIPTION

Figure 1:
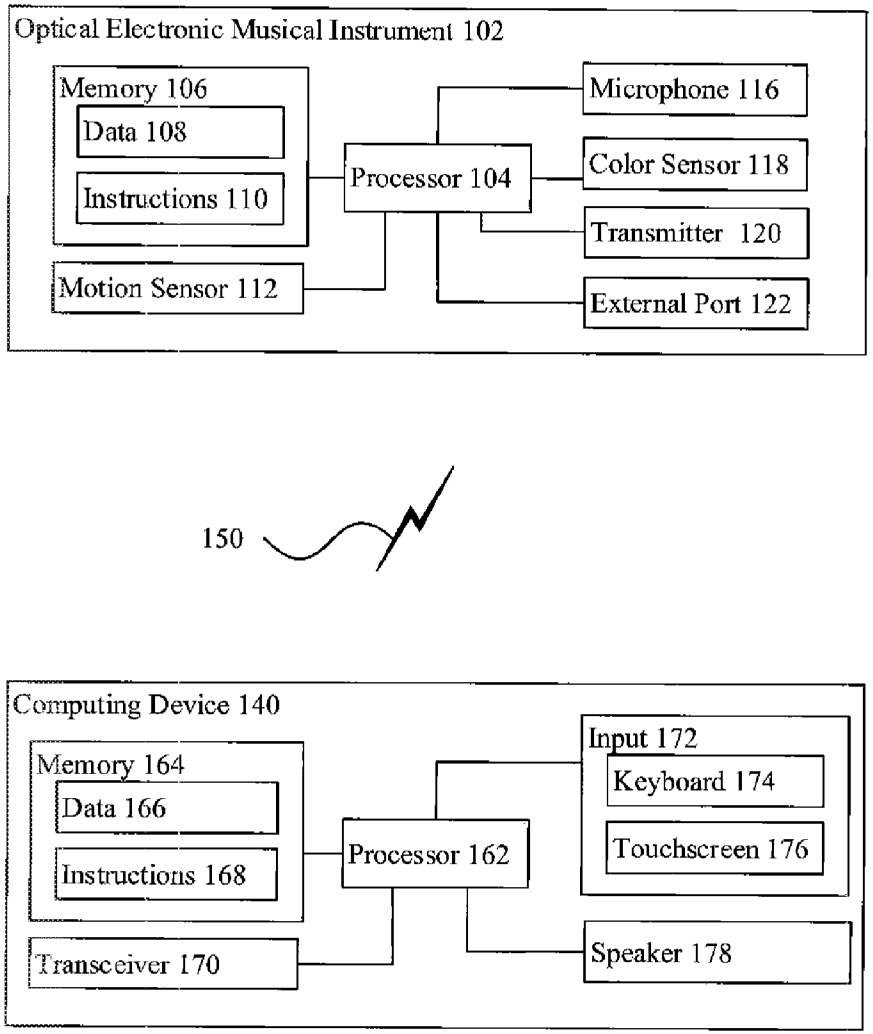
FIG. 1 is a block diagram of a system in accordance with aspects of the present disclosure.

The present disclosure may be understood more readily by reference to the following detailed description of the disclosure taken in connection with the accompanying figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Reference will now be made in detail to the exemplary embodiments of the present disclosure, which are illustrated in the accompanying drawings.

An electronic optical musical instrument ("e-instrument") that produces sound based on the detection of individual colors is disclosed herein. The e-instrument may include a color sensor that identifies a particular color upon coming in close proximity with the color, thereby generating a color signal based on the detected color. The e-instrument may further include a motion sensor, such as an accelerometer, that outputs an amplitude based on a detected acceleration of the e-instrument before coming in close proximity or otherwise coming into contact with a surface that the color is on. The output generated by the motion sensor may be determined based on the e-instrument moving from a first position to a second position. The first position being a starting position a certain distance from the color, the second position being within close proximity to the color. The generated amplitude by the motion sensor may be sent to the processor, which then processes the received amplitude and generates a motion signal based thereon.

Once the color signal and the motion signal are generated, both signals are sent to a computing processor. The computing processor will generate a sound signal based on the received color signal and motion signal and send the sound signal to a speaker to output a sound based on the sound signal. The computing processor and/or speaker may be within the same housing as the e-instrument or remote therefrom. For instance, the e-instrument may send the color signal and the motion signal to a computing device that includes the computing processor, which then transmits the sound signal to the speaker. In addition, the speaker may be included in the computing device itself. Nonetheless, the e-instrument may include a processor and transmitting capabilities in order to transmit the sound signal and motion signal to the computing processor of the computing device, such as via Bluetooth.

Figure 2:
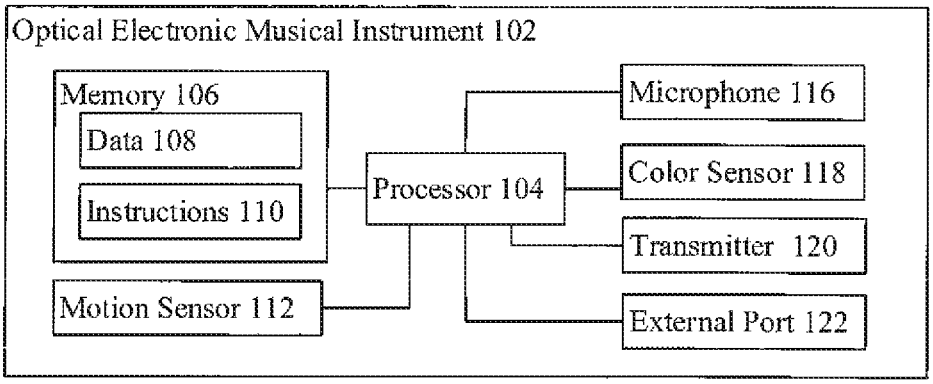
FIG. 2 is a block diagram illustrating a computing device in the system of FIG. 1 in accordance with aspects of the present disclosure.
Figure 2:
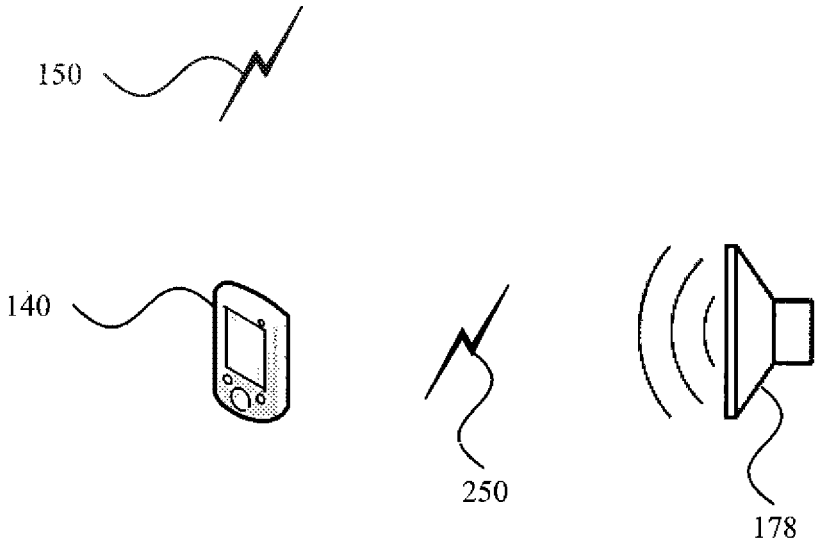

FIGS. 1 and 2 illustrate an example system of the above e-instrument and computing device. It should not be considered as limiting the scope of the disclosure or usefulness of the features described herein. In this example, the system can include e-instrument 102 and computing device 140. E-instrument 102 and computing device 140 can contain one or more processors, memory, and other components typically present in an electronic device.

With respect to e-instrument 102, memory 106 can include data 108 that can be retrieved, manipulated or stored by processor 104. Memory 106 can be of any non-transitory type capable of storing information accessible by processor 104, such as a hard-drive, memory card, Read Only Memory ("ROM"), Random Access Memory ("RAM"), Digital Versatile Disc ("DVD"), Compact Disc Read Only Memory ("CD-ROM"), write-capable, and read-only memories.

Instructions 110 can be any set of instructions to be executed directly, such as machine code, or indirectly, such as scripts, by processor 104. In that regard, the terms "instructions," "application," "steps" and "programs" can be used interchangeably herein. Instructions 110 can be stored in object code format for direct processing by processor 104, or in any other computing device language including scripts or collections of independent source code modules that are interpreted on demand or compiled in advance. Functions, methods and routines of the instructions are explained in more detail below.

Data 108 can be retrieved, stored or modified by processor 104 in accordance with instructions 110. For instance, although the subject matter described herein is not limited by any particular data structure, data 108 can be stored in computer registers, in a relational database as a table having many different fields and records, or eXtensible Markup Language ("XML") documents. Data 108 can also be formatted in any computing device-readable format such as, but not limited to, binary values, ASCII or Unicode. Moreover, data 108 can comprise any information sufficient to identify the relevant information, such as numbers, descriptive text, proprietary codes, pointers, references to data stored in other memories such as at other network locations, or information that is used by a function to calculate the relevant data.

Processor 104 can be any conventional processor, such as a commercially available Central Processing Unit ("CPU"), that is specially programmed to operate e-instrument 102 as described herein. Alternatively, processor 104 can be a dedicated component such as an Application-Specific Integrated Circuit ("ASIC") or other hardware-based processor. Although not necessary, e-instrument 102 may include specialized hardware components to perform specific computing processes, such as decoding video or sound, etc.

E-instrument 102 may also include other devices in communication with processor 104, such as motion sensor 112. Motion sensor 112 may include any device that is capable of detecting motion or orientation or changes thereto of e-instrument 102, including one or more accelerometer(s), gyroscope(s), force sensitive resistor(s), etc; other motion sensing components are contemplated. For instance, an accelerometer may track increases or decreases in acceleration and a gyroscope may determine at least one or all of a pitch, yaw, or roll (or changes thereto) of e-instrument 102 relative to the direction of gravity or a plane perpendicular thereto. By way of example only, the implemented accelerometer may be an ADXL377, which is a triple axis, ±200 g accelerometer, or alternatively using an AD22301, which is a single-axis, ±70 g accelerometer. In this regard, a single-axis or a multi-axis accelerometer may be used to detect magnitude and direction of acceleration. As a further example, the accelerometer may be a Micro Electro-Mechanical System ("MEMS") in order to fit within the various forms e-instrument 102 can be. Furthermore, the gyroscope may be any type of mechanical or MEMS type gyroscope, etc. It should be understood that any discussion of motion sensor 112 includes one or more of the accelerometer(s), gyroscope(s), etc.

E-instrument 102 may further include color sensor 118 that identifies individual colors that the color sensor is placed in close proximity with. As one example, color sensor 118 may be an Ams-Taos TCS34725FN integrated circuit color sensor, or alternatively an Adafruit TCS34725 RGB color sensor, both color sensors of which may include a built-in white LED. The white LED may be used to illuminate a surface to obtain a more accurate color reading, although it should be understood that the white LED light is not necessary for the operation of color sensor 118 and e-instrument 102. Other color sensors that are capable of identifying particular colors from a plurality of colors when the color sensor is placed within a detectable or otherwise operational range of the particular color are possible as well.

E-instrument 102 may further include wireless technology in order to communicate with devices within its Personal Area Network. For instance, e-instrument 102 includes transmitter 120 in order to communicate with external devices. As depicted in FIGS. 1 and 2, transmitter of e-instrument 102 may be used to communicate with computing device 140, as illustrated by communication link 150. Transmitter 120 may communicate with computing device 140 using short-wavelength ultra high frequency radio waves from 2.4 to 2.485 GHz, such as using Bluetooth®. In addition, other wireless communications in addition to or as an alternative to Bluetooth may be implemented as well, such as communications over Wi-Fi, a Local Area Network ("LAN"), Wide Area Network ("WAN"), or the Internet. Other methods of e-instrument 102 communicating with computing device 140 are also possible. For example, a wire may be employed to establish communication between e-instrument 102 and computing device 140, such as by using external port 122. External port 122 may be configured to receive one or more of a headphone jack, USB, micro-USB, etc. In this regard, any reference to communication link 150 should not be restricted to any particular form of connection, but rather can be Bluetooth, the Internet, wired, etc. Furthermore, although FIGS. 1 and 2 may depict e-instrument 102 and computing device 140 being proximal to each other, the devices may in fact be further remote from each other, such as in different rooms or in different structures altogether.

Computing device 140 may include processor 162, memory 164, data 166, and instructions 168. As depicted in FIG. 2, computing device 140 is a smart phone. However, it should be understood that computing device 140 may be any computing device capable of performing the functions described herein. For instance, computing device 140 may be a personal computer, laptop, netbook, tablet, smart watch or other wearable computing device, etc.

Memory 164 of computing device 140 can include data 166 that can be retrieved, manipulated or stored by processor 162. Memory 164 can be of any non-transitory type capable of storing information accessible by processor 162, such as a hard-drive, memory card, ROM, RAM, DVD, CD-ROM, write-capable, and read-only memories.

The instructions 168 can be any set of instructions to be executed directly, such as machine code, or indirectly, such as scripts, by processor 162. In that regard, the terms "instructions," "application," "steps" and "programs" can be used interchangeably herein. Instructions 168 can be stored in object code format for direct processing by processor 104, or in any other computing device language including scripts or collections of independent source code modules that are interpreted on demand or compiled in advance. Functions, methods and routines of the instructions are explained in more detail below.

Data 166 can be retrieved, stored or modified by processor 162 in accordance with instructions 168. For instance, although the subject matter described herein is not limited by any particular data structure, data 166 can be stored in computer registers, in a relational database as a table having many different fields and records, or XML documents. Data 166 can also be formatted in any computing device-readable format such as, but not limited to, binary values, ASCII or Unicode. Moreover, data 166 can comprise any information sufficient to identify the relevant information, such as numbers, descriptive text, proprietary codes, pointers, references to data stored in other memories such as at other network locations, or information that is used by a function to calculate the relevant data.

Processor 162 can be any conventional processor, such as a commercially available CPU. Alternatively, processor 162 can be a dedicated component such as an ASIC or other hardware-based processor. Although not necessary, computing device 140 may include specialized hardware components to perform specific computing processes, such as decoding video or sound, etc.

In addition and as illustrated in FIG. 1, computing device 140 may further include user input 172, which include one or more of keyboard 174 or touch screen 176. Other input devices are also possible, such as a microphone or mouse. Further, computing deice 140 may also include or be in communication with speaker 178 that is capable of receiving sound signals to output sound. The sound signals that speaker 178 outputs may include, for example, sounds that resemble various instruments such as a piano, trumpet, drums (e.g., snare drum, torn-tom, hi-hat, etc.), violins, and any other instrument. The various sounds that resemble instruments may be proprietary sounds that were developed, downloaded or otherwise acquired for each particular sound of each instrument. For instance, the sounds may have been downloaded and then edited for each individual sound, such as using Audacity®. Additionally, sound signals may include sounds that resemble comical noises in various tones, such as a sneeze, belch, etc. As a further example, the user may record his or her own sounds using a microphone, which will then play once color sensor 118 comes in operational proximity to the color that is associated with the recorded sound. It should be understood that the present technology is not limited to any particular sound, tone, volume, etc., but rather any sound signal that is output by a speaker is possible.

Computing device 140 may also include transceiver 170 in order to receive sounds from e-instrument 102. For instance, transceiver 170 may receive data using short-wavelength ultra high frequency radio waves from 2.4 to 2.485 GHz, such as using Bluetooth® technology. In addition or alternatively, transceiver may receive information over Wi-Fi. Furthermore, although computing device 140 depicts speaker 178 being within the same housing as computing device 140, it should be understood that speaker 178 may be a separate component remote from computing device 140 or e-instrument 102, as shown in FIG. 2. For instance, speaker 178 may include a processor and a transceiver to receive sound signals from one or more of computing device 140 or e-instrument 102 over communication link 250. Speaker 178 may receive various signals from computing device 140 or e-instrument 102 using Bluetooth, a wired connection, etc. Further, the present technology is able to function as long as speaker 178 is in communication with e-instrument 102, computing device 140, or both, such that speaker 178 at the very least is able to receive and then output the sound signals.

Figure 3:
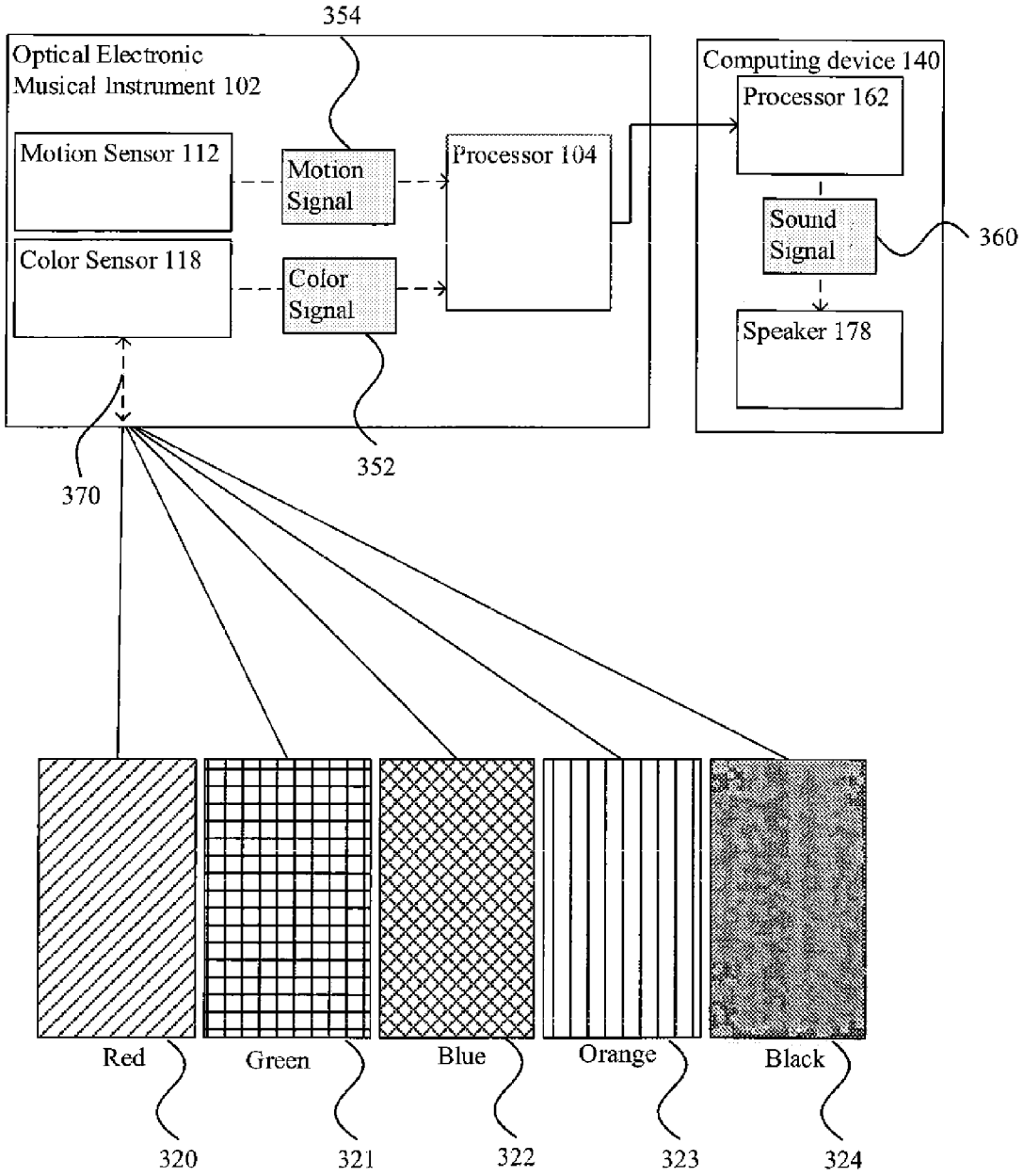
FIG. 3 is a block diagram illustrating the production of various signals and generation of a sound signal in accordance with aspects of the present disclosure.

FIG. 3 illustrates one example of e-instrument 102 in operation. For instance, e-instrument may operate by reading colors on surfaces 320-324, each pattern on each surface 320-324 represents a particular color as indicated below each patterned surface. Surfaces can be any surface off of any object or material, including a table, chair, shirt, pants, wall, rug, paper, etc. Surface 320 represents red, surface 321 represents green, surface 322 represents blue, surface 323 represents orange, and surface 324 represents black. It should be understood that the various patterns are illustrative only and used to differentiate between the various colors. Further, color sensor 118 of e-instrument 102 may be capable of identifying any number of colors and any variety of shades of colors in addition to the colors represented in FIG. 3.

As depicted in FIG. 3, when color sensor 118 is placed in operational proximity to surfaces 320-324, color sensor 118 is able to identify the color of that particular surface. For example, in an 8-bit data unit color sensor 118 may operate by measuring RGB values of a color on a surface, where each R, G, and B value ranges from 0 to 255. As described in further detail below with respect to the musical application, if no colors are stored in memory 164 of computing device 140, then the measured color by color sensor 118 is identified as a new color and stored in memory 164. Additionally, if memory 164 has at least one color stored in memory 164 at the time color sensor 118 measures a color, then the measured value associated with that color is compared with the stored color values. If the measured color value is the same, or within a threshold amount as discussed in further detail below, as a color already measured and stored, then the sound associated with the already stored color is output. Conversely, if the measured color value is different than all of the stored color values, then the color is deemed new, and as a result computing device 140 will store that new measured color value in memory 164, associate a sound with that new measured color value, and perform any other processing necessary.

In determining whether the measured color value is new or not, that is, whether the measured color value comports with an already stored color or not, a threshold ratio value may be determined for each measured color. The threshold ratio value may be, as one example, a numerical value. For example, a calculation may be performed on each measured color to determine an acceptable level of difference between the stored color and the measured color. For example, even if a measured color is not identical to a stored color, the measured color may be similar enough to the stored color that the two colors will be considered the same programmatically. However, if the difference between the measured color value and the stored values is significant enough, then the measured color value will be considered a new color programmatically.

In order to determine if a measured color is similar or different to the stored color values, as one example a ratio may be calculated by either dividing each RGB value by the sum of the RGB values, or dividing by the magnitude of the RGB values, such as $\sqrt{(R^2G^2B^2)}$. From here, the calculated ratios of each of the RGB values for the measured color are compared to each of the RGB ratios of the stored colors. As one example, the RGB ratio of yellow would be $\sqrt{0.5,0.5,0}$), which has a corresponding RGB value of $\sqrt{255,255,0}$). If each RGB ratio (i.e., the R ratio, G ratio, and B ratio) of the tapped color falls within a certain threshold ratio value of each of the RGB ratios of a particular stored color, then the measured color is determined to be that stored color. In determining whether the measured color value is determined to be the same as the stored color value, the threshold ratio value may be, for example, 0.043 for each of the RGB values. Therefore, if at least one of the stored color RGB values are off by more than 0.043, then the measured color will be considered different than all of the stored colors, and thereby new.

As an example, a stored yellow color may have a stored RGB ratio of [0.5, 0.5, 0]. If the same or different yellow surface was tapped, but this time color sensor 118 measured RGB values of the yellow surface as [254,253,1], this translates to an RGB ratio of [0.5, 0.498, 0.00197] using the $\sqrt{(R^2G^2B^2)}$ formula referenced above. Because all components of this RGB ratio vector are within the ratio threshold of 0.043 from each respective component in the stored yellow=[0.5,0.5,0], the measured color is programmatically determined to be the same yellow color stored in memory. If one of the three R, G, or B, ratio values were off by enough, such as the 0.043 value, then the color is programmatically determined to be different then the stored yellow color. Other threshold color value differences may also be implemented, such as depending on the particular purpose the system is designed for, etc.

In addition to the measured ratio value being within a certain threshold ratio of the stored color values, another threshold may also be implemented in order to detect colors that have the same ratio, but significantly different RGB measurements. As one example, this other threshold may distinguish between white and similarly valued colors and black and similarly valued colors. For example, white has an RGB ratio of [0.33, 0.33, 0.33] and black has an RGB ratio of [0, 0, 0]. In this regard, the magnitude of the measured RGB values, that is $\sqrt{(R^2G^2B^2)}$, may be within a separate threshold from the measured magnitude of the RGB values of that stored color. This separate threshold may be considered an RGB threshold value. The RGB threshold value may be defined such that the measured color value of each R, G, and B magnitude is equal to or within 500 of each of the R, G, and B magnitude of each of the stored colors that the measured value is compared with. Other threshold values are also possible, such 450, 750 or any other value including and between 1 and 1024.

If the threshold color value and the RGB threshold value are both satisfied, then the color is considered the same as the stored color that the measured color value matches. In this scenario and as discussed in further detail below, the sound associated with the already stored color value may be output, as opposed creating a new sound. However, if one or more of the two threshold values are not satisfied, then the measured color is determined to be new and thereby is stored in memory 164. The newly stored measured color may then be compared with, along with all of the other stored color values, any subsequently measured color values by color sensor 118. In that regard, the process described above repeats itself for each color measured by color sensor 118. In particular, each measured color is determined to either be matched with a stored color, or determined to be new and thereby stored in memory 164.

As a further example or as an alternative, stored in memory 106 of e-instrument 102 may be a similarity function that color sensor 118 employs in order to accurately identify a color. By way of example only, the following two formulas may be implemented to identify a color:

$$h_y(\vec{x}) = \underset{y \in Y}{\operatorname{argmax}} \left[ \sum_{i=1}^{4} \left( \frac{x_i - x_{y,i}}{s_{y,i}} \right)^n \right]^{\frac{1}{n}} \tag{1}$$

$$h_y(\vec{x}) = \underset{y \in Y}{\operatorname{argmax}} \left[ \sum_{i=1}^{4} \left( \frac{\frac{x_i}{|\vec{x}|} - \frac{x_{y,i}}{|\vec{x}_y|}}{s_{y,i}} \right)^n \right] \tag{2}$$

Where y is a color in the calibrated set Y, $\vec{x}$ is a vector containing the digital values associated with the measurements of $i \in \{R, G, B, clear\}$, $x_{y,i}$ is the average measurement of i values among all training samples for color y, and $s_{y,i}$ is the standard deviation of i values among all training samples of y, normalized over $s_y$.

Both equations effectively determine the color in the calibrated set with the minimal $L_n$ distance between its own color values and those of a newly measured color. Equation 2 differs in that it compares distance between the normalized color measurement vectors $$\frac{\vec{x}}{|\vec{x}|}$$

and $$\frac{\vec{x_y}}{|\vec{x_y}|};$$

in other words, Equation 2 checks for similarity in the ratio R, G, B, and clear values between colors, while Equation 1 in the values themselves. The standard deviation measurements $s_{y,i}$ are used in both equations to weigh down color values that tend to vary significantly. It should be understood that the above algorithms are exemplary only, and other algorithms that are implemented in order to identify particular colors may be used in the present technology.

Using any of the systems and methods discussed above, color sensor 118 may identify a particular color when placed within operational proximity to the color. Operational proximity may depend on the particular color sensor employed. For instance, operational proximity may be contact with the color or close proximity to the color, such as one, two, or three centimeters from the color. Other distances are also possible. In addition, color sensor 118 may further include or be in communication with a Light Emitting Diode ("LED") that emits light to help illuminate a surface of the color that color sensor will come in close proximity with. In this regard, the light emitted from the LED may aid color sensor 118 in identifying the color that color sensor 118 is in operational proximity. It should be understood that e-instrument 102 may operate with or without the LED.

As an example and referring to FIG. 3, color sensor 118 may be placed within operational proximity to surface 320, and as a result color sensor 118 is able to recognize the color of the portion of surface 320 that color sensor 118 is positioned in front of. In this regard, color sensor 118 is capable of identifying, as one example, any and all of colors red, green, blue, orange, and black, on their respective surfaces 320-324, as shown in FIG. 3. As further illustrated in FIG. 3, double arrow 370 represents color sensor 118 identifying the color and also the potential output by color sensor 118 of an LED, if implemented. From here, color sensor 118 generates color signal 352 which correlates to the particular color that color sensor 118 was in operational proximity. Color signal 352 may be any color that color sensor 118 identified, such as red, green, blue, orange, or black as illustrated in FIG. 3. Surfaces 320-324 and the colors associated therewith are exemplary only, and it should be understood that color sensor 118 may detect any number of colors, including shades of different colors, such as any shade from dark to light, including dark red to light red, dark green to light green, dark blue to light blue, etc.

In addition, although surfaces 320-324 are illustrated as being a single color, it should be understood that a surface may comprise a plurality of different colors. In this regard, color sensor 118 may identify the color that color sensor 118 is positioned in front of e.g., within operational proximity. For instance, a user may create a surface that has a plurality of colors thereon, that way the user can easily use and make sounds with e-instrument 102 on a plurality of colors. The surface with the plurality of colors may be a single surface that is painted multiple colors, a bunch of different color surfaces positioned adjacent to each other, or a combination thereof. As a further example, the colors may be spaced apart from each other.

Furthermore, as depicted in FIG. 3 motion sensor 112, when implemented as an accelerometer, generates voltage with a particular amplitude based on a measured acceleration of e-instrument 102, the generated amplitude is then transmitted to processor 104. Motion sensor 112 may be used to detect when an object has been tapped. For instance, motion sensor 112 generates an amplitude of voltage based on the level of acceleration of e-instrument 102 when e-instrument 102 is in use. As an alternative or another example, an Inter-Integrated Circuit Protocol ("I2C") communication may be implemented. In this regard, motion sensor 112 may generate the motion signal and, using an on-board processor associated with motion sensor 112, develop an 8-bit signal. Therefore, the voltage or the 8-bit signal may be referred to collectively as motion signal 354, as shown in FIG. 3.

Motion signal 354 may influence the volume level of sound signal 360 that is ultimately output. For instance, higher motion signal values that are output based on higher measured acceleration may result in a higher volume level, and lower motion signal values that are output based on lower measured acceleration may result in a lower volume level. The user may move e-instrument 102 from a first position to a second position, the first position being a certain distance from a surface, such as surface 220, and the second position being where color sensor 118 is in operational proximity to surface 220. The acceleration between the first position and the second position may be measured by motion sensor 112 and then a corresponding motion signal is output.

From here, motion signal 354 from motion sensor 112 is transmitted to processor 104 for processing. In this regard, motion signal 354 is based on the difference between zero and the highest level of acceleration that motion sensor 112 detected. As another example, motion signal 354 may be determined according to other calculations as well. Motion signal 354 may be determined based on the measured acceleration at a particular point in time, such as any point in time between and including e-instrument 102 moving from the first position and the second position. As a further example, motion signal 354 may be determined based on an average or mean of the highest detected rate of acceleration and the lowest detected rate of acceleration.

A filter may also be employed so that certain motions detected by motion sensor 112 are used and others are not. The purpose of adding a filter, such as a high pass filter, is to attenuate high accelerations associated with quick hand movements (i.e., not taps) or other movements not directly associated with tapping a surface. The high-pass filter may be hardware based, software based, or a combination of the two. For example, the hardware may include resistors, capacitors, and an operational amplifier (op-amp) performing as a comparator. The op-amp comparator may include a threshold signal, such as a threshold amplitude, that is compared with motion signal 354 from motion sensor 112. If motion signal 354 satisfies or otherwise exceeds the threshold signal of the comparator, then motion signal 354 is transmitted to processor 104. Conversely, if motion signal 354 fails to satisfy or exceed the threshold signal of the comparator, then motion signal 354 is not transmitted to processor 104.

The threshold signal may reduce or eliminate hand waves and jerks affecting the operability of e-instrument 102. For instance, it may not be desirable for e-instrument 102 to operate when the user is wantonly or unknowingly moving e-instrument 102 without intentionally using the device. In this scenario, the high-pass filter described above ensures that e-instrument 102 is operating as a result of intentional taps and uses. Furthermore, high amplitudes may still occur with hand waves or jerks, which is why the high-pass filter is useful in reducing those amplitudes so that they are low in comparison to surface taps (even really soft taps). For instance, a hand wave or jerk may result in high generated amplitudes, but the hand wave or jerk also results in a more gradual decrease in acceleration. In this regard, the sharp spike that would result from tapping a surface may not occur for hand waves and jerks, since the hand waves and jerks may result in a decrease in acceleration as opposed to the sharp spike as a result of tapping a surface.

The high-pass filter may also be implemented using processor 104. Requirements of the high-pass filter may be stored in memory 106 and implemented using processor 104. Thus, motion sensor 112 may output amplitude that is received by processor 104, and processor 104 executes instructions 110 from memory 106 to determine how to process and use the received amplitude output, i.e., the motion signal. In this regard, as discussed above processor 104 may compare motion signal 354 to a pre-determined threshold signal, such as a threshold amplitude. If the threshold signal is satisfied, then motion signal 354 is transmitted and if the threshold signal is not satisfied, then motion signal 354 is not transmitted.

In addition, a threshold voltage may be chosen in order to mark the start of a tap. For example, in one scenario quick hand jerks may be identified as taps rather than soft taps on a soft surface. Although the hand jerks have been attenuated, soft hits on soft surfaces have very low maxima. As a result, a threshold may be implemented to increase the difference between the number of certain hits and jerks being triggered.

The use of the high-pass filter may also trigger the operation of color sensor 118 and processor 104. For example, color sensor 118 and processor 104 may be in a sleep mode until it is determined, such as via the high pass filter, that motion signal 354 is legitimate, that is, a result of an intentional tap by the user. Once the high-pass filter determines that motion signal 354 is legitimate, an activation signal may be sent to color sensor 118 to activate color sensor 118 and thereby capture a color positioned in operational proximity to color sensor 118. Similarly, processor 104 may be in sleep mode until receiving motion signal 354 from motion sensor 112, at which point processor 104 will wake up and operate. As discussed above, however, in the event processor 104 determines whether motion signal 354 is legitimate or not, processor 104 will operate each time motion sensor 112 transmits a signal in the form of a measured motion.

In view of the above and as further illustrated in FIG. 3, once color sensor 118 and motion sensor 112 generate color signal 352 and motion signal 354, respectively, the two signals are then transmitted to processor 104. In this regard, motion signal 354 and color signal 352 are both related in that both signals apply to one particular use of e-instrument 102. For instance, color sensor 118 and motion sensor 112 both develop their respective signals when c-instrument 102 is used, and as discussed further below the processing of the two signals together provides the user with an overall sound that the user intended to create.

When processor 104 receives color and motion signal 352 and 354, processor 104 may use, as one example, transmitter 120 to transmit the respective signals to computing device 140. In this regard, processor 104 may be used to receive and transmit color signal 352 and motion signal 354 to another computing device, such as computing device 140. As a further example, e-instrument 102 may transmit the respective signals using a wire as well via external port 122, such as a headphone jack, USB wire, micro-USB wire, etc. As shown in FIGS. 1 and 2, communication link 150 represents any method of communication between the devices, wired or wirelessly. As another example, e-instrument 102 may communicate with computing device 140 using other wireless technology, such as the Internet, Wi-Fi, etc.

When computing device 140 receives color signal 352 and motion signal 354 from e-instrument 102, processor 162 may process the information and generate sound signal 360 based on color signal 352 and motion signal 354. The determination and generation of sound signal 360 depends on color signal 352 and motion signal 354. Thus, changes to color signal 352 or motion signal 354 may also result in a change to the generated sound signal 360 by processor 162.

The generated sound signal 360 based on color signal 352 and motion signal 354 may be fixed and predetermined or customizable by the user. For instance, the sounds may be pre-set and fixed to a guitar, piano, violin, clarinet, etc. In addition, the sounds may be set at be at certain pitches, tones, high or low notes, volumes etc. Alternatively, any sound, tone, pitch, or instrument may be incorporated into memory 164 of computing device 140, and the individual user selects which instrument, tone, pitch, volume, high or low note, etc. that he or she desires. As a further example, the user may be able to create his or her own sounds such as by using a microphone associated with computing device 140, or to alternatively manipulate and create sounds already stored or otherwise accessible by computing device 140. For instance, on a display of computing device 140 the user may be prompted to select a particular instrument from a plurality of instruments, and then tone, pitch, notes, etc. The ability of a user to select the sounds is discussed in further detail below.

As one example, computing device 140 may include in memory 164 a table that correlates each color to a particular sound, tone, instrument, etc. For example, the color red may correspond to a music note C, as illustrated in example 1 of table 410 of FIG. 4. As further illustrated by example 1 of table 410, the color green corresponds with a music note D; the color blue corresponds with the music note E; the color orange corresponds with the music note F; and the color black corresponds with the music note G. It should be understood that the color to sound correspondence table is exemplary only, and any color may be associated with any sound, instrument, volume, tone, etc., as selected by the user or preset and fixed in memory. For instance, table 410 of FIG. 4 also illustrates examples 2 and 3 as additional exemplary embodiments of the color to sound association. These notes may be output by a variety of instruments, such as a trumpet, piano, guitar, etc. In addition, references to specific colors, such as red, green, blue, etc., may similarly be read as executable data by a processor. For example and as discussed above, various colors may be transmitted as and processed by RGB color code, such as RGB=[255,0,0] for red, RGB=[0, 255, 0] for green, RGB=[255, 255, 0] for yellow, etc. Other designations and methods of identifying particular colors may be used as well.

Figure 5:
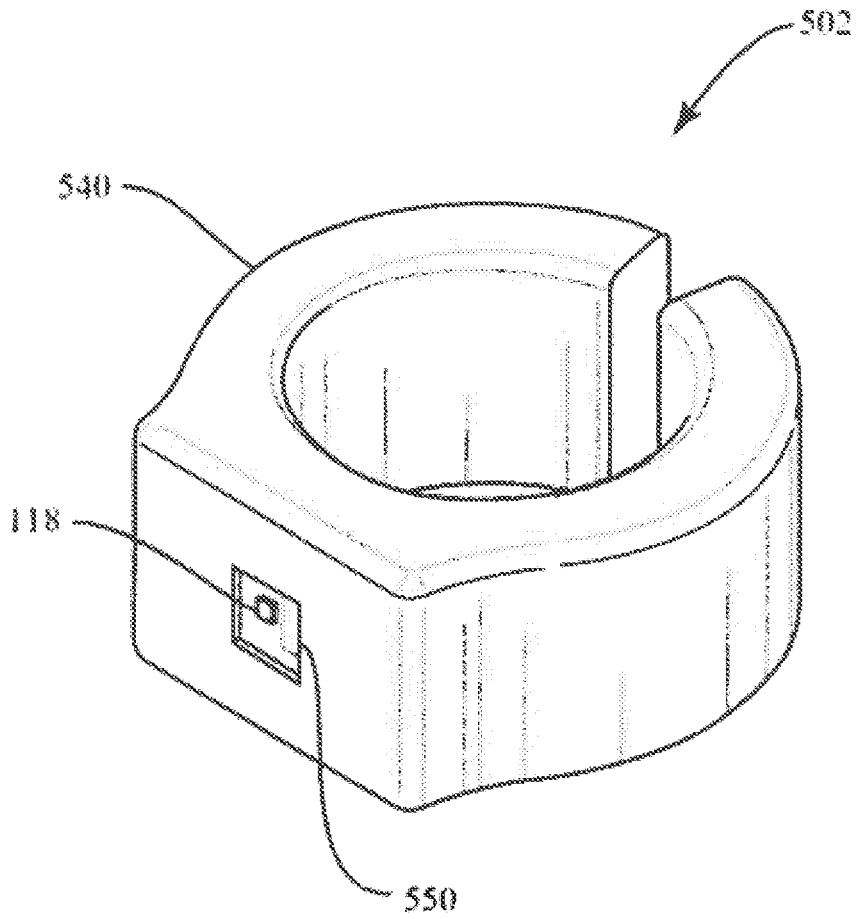
FIG. 5 is a ring-shaped electronic optical musical instrument in accordance with aspects of the present disclosure.

One apparatus that the above e-instrument 102 may be used in is depicted in FIG. 5. For instance, FIG. 5 illustrates a ring-shaped electronic instrument 502 ("ring shaped e-instrument") that is configured to be placed around a finger of a user. In this example, color sensor 118 is depicted within a hole 550 defined by housing 540 of ring-shaped e-instrument 502. Hole 550 may further include a clear piece of plastic or acrylic over color sensor 118 as protection. Furthermore, housing 540 of ring-shaped e-instrument 502 further includes components of e-instrument 102 as discussed above, such as one or more of a processor, memory, a motion sensor, orientation device, microphone, transmitter, and an external port. All of these components may function similarly as discussed above with respect to e-instrument 102. In addition, ring-shaped e-instrument 502 may include a power button (not shown) thereon that powers on and off ring-shaped e-instrument 502. Alternatively, the power button may be used for other functions as well, such as to reset ring-shaped e-instrument 502, syncing ring-shaped e-instrument 502 with computing device 140 over Bluetooth, changing the sound of a tapped surface, etc. Furthermore, any device that e-instrument 102 is designed with may include the power button to power on and off, reset, sync, change volume, etc. of e-instrument 102. Ring-shaped e-instrument 502 may be waterproof as well, such as all of the internal components and electronic circuitry may be housed in a rubber mold and completely sealed from external debris, water, etc. As a further example, housing 540 may be comprised of a transparent material such that housing 540 does not include hole 550 to expose color sensor 118. In this regard, color sensor 118 can detect colors on surfaces without the hole because housing 540 is transparent.

A user may wear ring-shaped e-instrument 502 on their finger and tap or come in close proximity to a surface that has a color. Ring-shaped e-instrument 502 may generate a color signal and a motion signal and send the respective signals to a processor associated with ring-shaped e-instrument 502. Ring-shaped e-instrument may transmit the color signal and motion signal to a computing device, such as computing device 140 as discussed above, which then generates a sound signal based on the color and motion signals. Computing device 140 may then generate a sound signal using computing device processor 162, the sound signal then being output by a speaker that is in communication with computing device processor 162.

Figure 6:
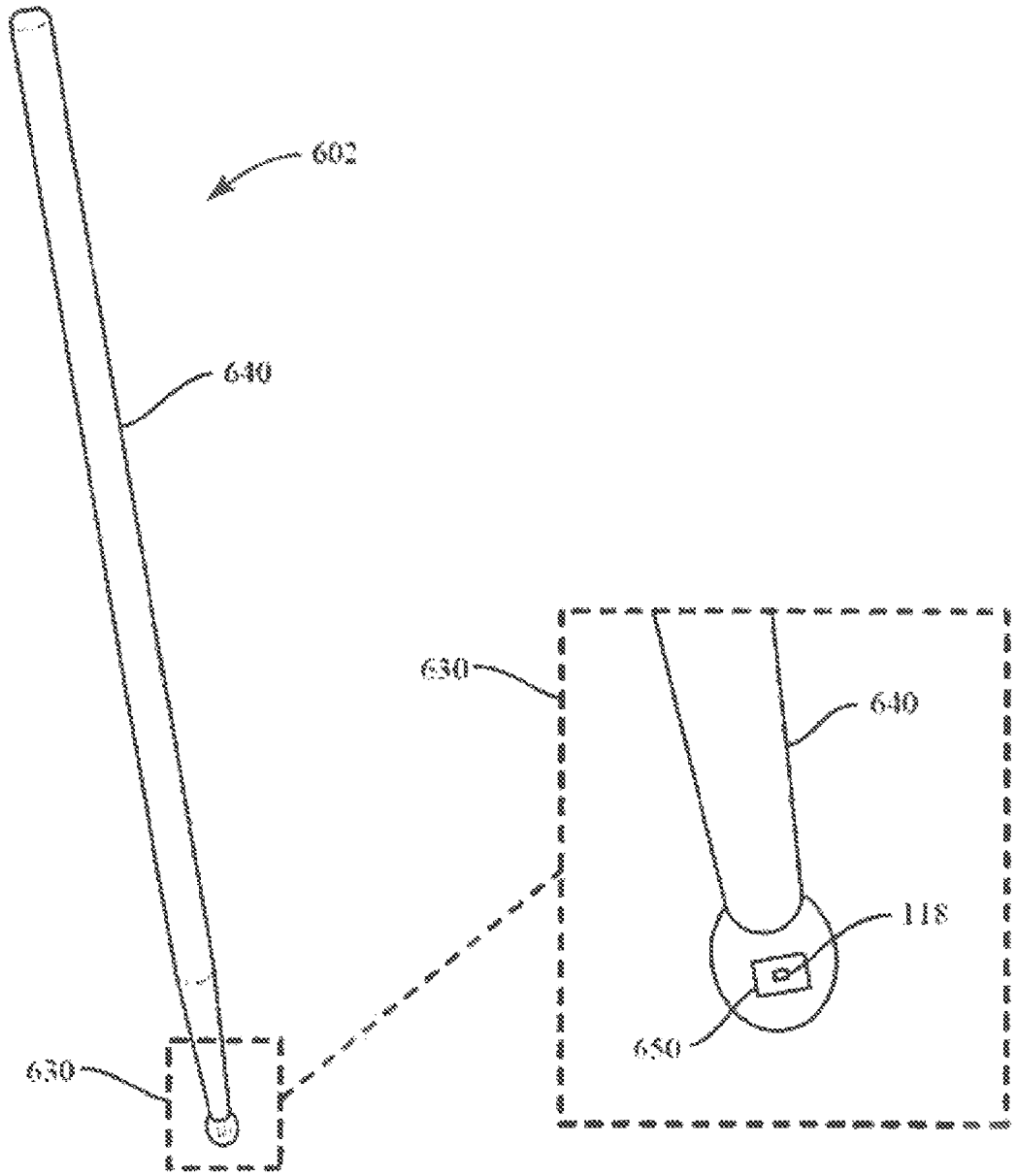
FIG. 6 is device shaped like a drum stick that includes the electronic optical musical instrument in accordance with aspects of the present disclosure.

As another example, an apparatus including the above features may be a device that resembles a drumstick, as illustrated in FIG. 6. Drumstick 602 includes housing 640 that houses the various components discussed above with respect to e-instrument 102, such as a processor, memory motion sensor, orientation device, microphone, color sensor, Bluetooth, and an external port. Furthermore and as discussed above, drumstick 602 may include a power button (not shown) that is configured to power on and off or reset drumstick 602. For example, as illustrated in FIG. 6, view 630 shows color sensor 118 within housing 640 that defines hole 650. In this regard, a user may tap or come within close proximity to a color on a surface such that color sensor 118 is within operational proximity to the color. Motion sensor 112 may generate a motion signal as well based on the user moving drumstick 602 from a first position to a second position, the second position being within close proximity to the color, such that color sensor 118 is able to detect and identify the particular color. As another example, color sensor 118 may be positioned at a tip pointed along the longitudinal axis of drumstick 602, and the tip may further include a plurality of mirrors to reflect colors to color sensor 118. In this scenario, the user may grasp and use drumstick 602 at any location thereon without worrying about the positioning of color sensor 118 being able to directly contact the color on the surface. Rather, the mirrors surrounding the tip reflect the particular color to color sensor 118 for processing. As a further example or alternative, multiple color sensors may be employed on drumstick 602, such as around the tip, to reduce or eliminate the user having to grasp drumstick 602 in a particular fashion. Furthermore, any device, whether ring-shaped e-instrument 502, violin, etc., may employ mirrors, multiple color sensors, or combinations thereof to provide more accurate and reliable readings of particular colors.

From here, color sensor 118 may generate a color signal and the motion sensor may generate a motion signal, both signals of which are then sent to a processor within drumstick 602. The processor may then send the color and motion signals to a computing device, such as computing device 140, which will use computing device processor 162 to generate a sound signal.

Figure 7:
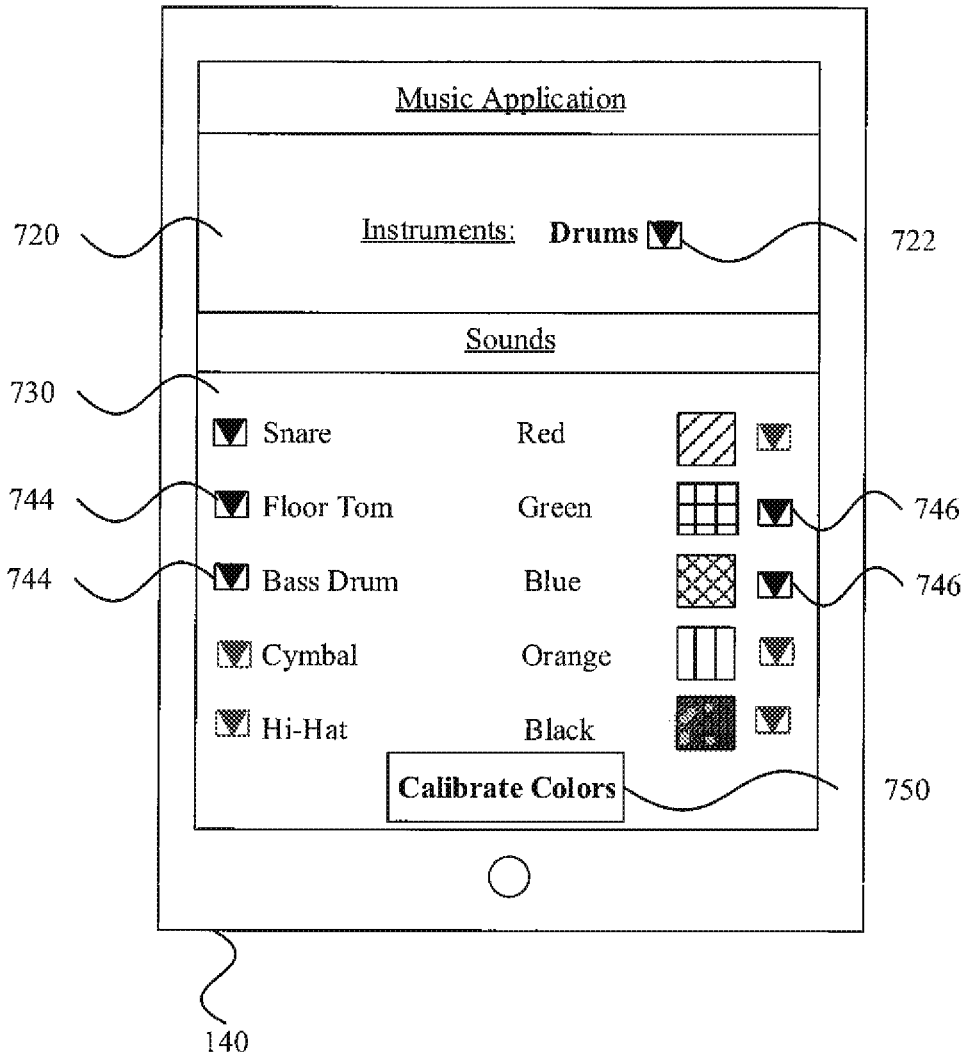
FIG. 7 illustrates a music application in accordance with aspects of the present disclosure.

As shown in FIG. 7, a music application may be developed that allows a user to customize the output sounds. For instance, as illustrated on the display of computing device 140, the selected instrument is Drums in display portion 720. In addition, there is a drop-down menu 722 adjacent to the selected instrument, in this case drums, that the user can select to see additional instruments offered by the music application. As discussed above, any sounds that resemble a particular instrument may be used and selected, such as a guitar, violin, organ, harp, etc.

Display portion 730 shows which sounds will be output by the speaker based on the particular color detected (i.e., the color signal). In this regard, as shown in FIG. 7 the color red corresponds to a snare drum sound, the color green corresponds to a floor tom sound, the color blue corresponds to a bass drum sound, the color orange corresponds to a cymbal sound, and the color black corresponds to a hi-hat sound.

The user may select the Calibrate Colors button 750 in order to calibrate particular colors with particular sounds, as shown in display portion 730. For instance, the user may hold color sensor 118 in front of a particular color, and then select the Calibrate Colors button 750 using one of the input 172 options that computing device 140 has. Once calibration is complete, the measured color will appear next to the particular drum sound. For example, with respect to the color red adjacent to the snare drum, the user may have held color sensor 118 of e-instrument 102 next to a particular color on a surface. Color sensor 118 identified the color and stored in memory 164 of computing device 140 the particular color, and then associated any future identification of the color red with the snare drum sound. This process may be performed for all of the remaining drum sounds as well.

As another example, sound drop-down menus 744 may be implemented to allow the user to select or change the sounds for each color. For instance, the snare sound corresponding with the color red may be switched to a floor tom. Similarly, color drop down menus 746 may also be implemented to allow the user to select different colors for each drum sound. For instance, the user may want a color pink to be associated with a bass drum sound, instead of the color blue as is currently shown in FIG. 7. Any combination of colors with sounds is possible, such as more than one sound being associated with a single color, or more than one color being associated with a single sound. Furthermore, currently display portion 730 shows various percussion sounds for the drums, but if the piano was selected, then the various sounds may be a variety of notes instead of particular percussion instruments. For example, if the piano was the selected instrument then the displayed sounds may be any note A, B, C, D, E, F, or G, including any flats ♭ or sharps #.

As a further example of the display and overall operability of computing device 140, memory 164 of computing device 140 may be null as to the storing of any colors. In this scenario, memory 164 will begin to populate with particular colors when the user begins using e-instrument 102. For example, when e-instrument 102 encounters a first color, such as the color red as identified by color sensor 118, then computing device 140 will store the color red in memory 164.

After the color red is identified and stored in memory, computing device 140 may automatically assign a sound, instrument, etc. to the color red. In addition, the color red may be displayed on the display of computing device 140, in which case the user may select, such as using the touch-screen display or other input mechanism, the color red in order to change the automatically populated settings associated with that color. For instance, by selecting the color red the user can change the instrument associated with that color, and characteristics associated with the instrument. The characteristics may include a note of that instrument, volume, and pitch. As one example, if a piano is chosen then the characteristic may be the note, and other characteristics may be electronic keyboard, organ, etc. Furthermore, if the drums are selected then characteristics may be tom-tom, snare, hi-hat, etc.

Although only a ring-shaped and drumstick shaped devices are discussed above, it should be understood that e-instrument 102 is not restricted thereto. Other types and shapes of devices are also possible. By way of example only, a plurality of e-instruments adapted to be secured to a plurality of fingers of a user may be implemented, such that the user can use the plurality of e-instruments in a piano-like fashion. In that regard, if multiple e-instrument devices are used on multiple fingers of the user, then a single processor may be implemented that communicates with the color and motion sensors coupled to each of the e-instrument devices. As an alternative, each e-instrument device may have its own respective processor that sends the sound signals to a computing device or speaker, the computing device and speaker being housed remote or local to the e-instruments. In addition, each e-instrument may include be capable of communicating with a single computing device or speaker, that way the user does not need multiple speakers to hear the sounds generated by each e-instrument. In this example, each e-instrument may communicate with a single processor that includes a transmitter and communicates with a computing device or speaker, this way there is only one route of communication among the plurality of devices.

Figure 8:
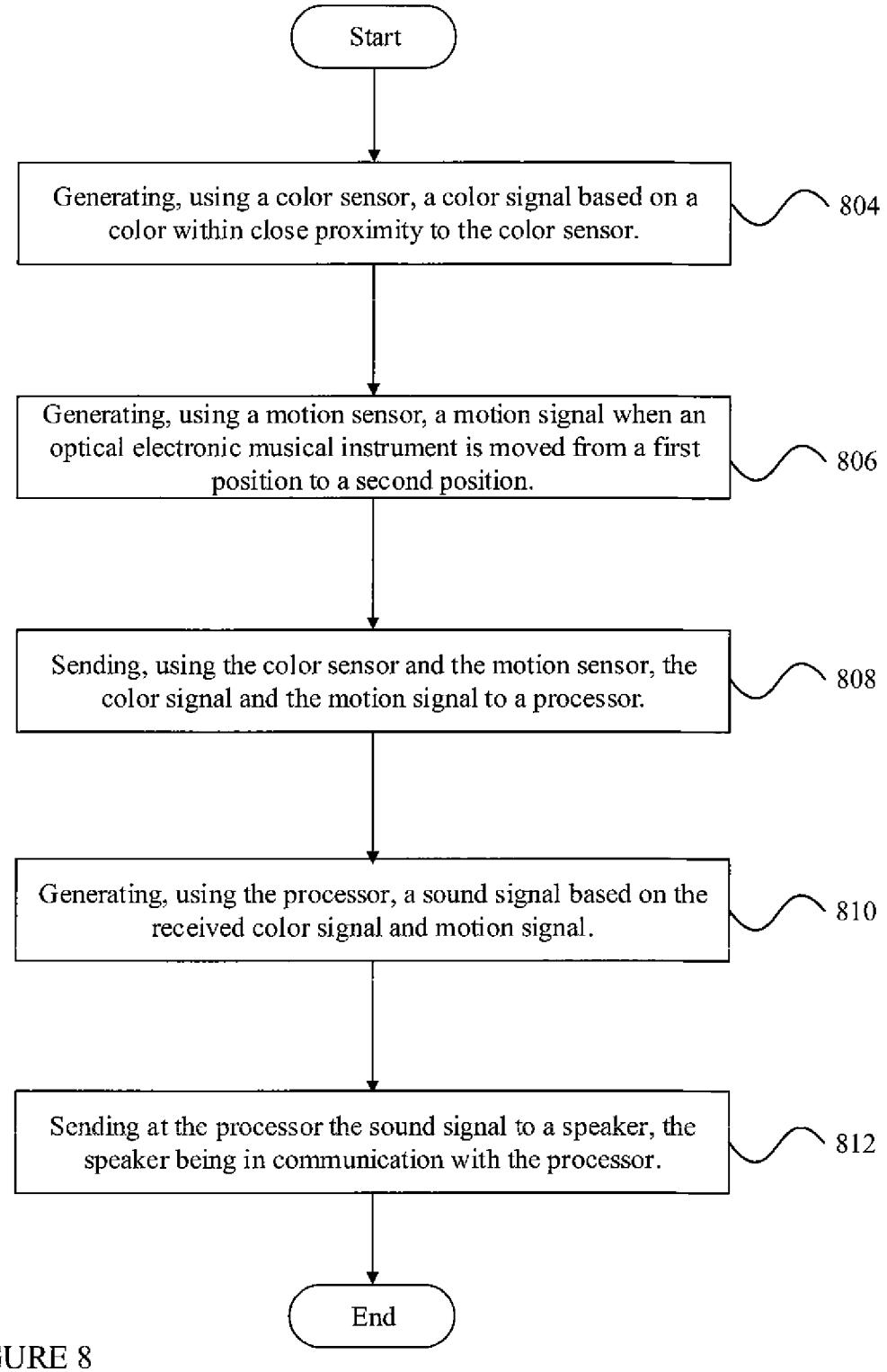
FIG. 8 is a flowchart of a method in accordance with aspects of the present disclosure.

FIG. 8 is a flowchart of one embodiment of the disclosure herein. A color sensor generates a color signal based on a color that is within close proximity to the color sensor, at step 804. At step 806, a motion sensor generates a motion signal when the e-instrument is moved from a first position to a second position, wherein the second position is when the color sensor is in operational proximity to the color. Next, the color sensor and motion sensor send the color signal and motion signal, respectively, to a processor, the processor being in communication with the motion sensor and the color sensor, at step 808. The processor then generates a sound signal based on the color and motion signals at step 810. At step 812, the processor sends the generated sound signal to a speaker that is in communication with the processor.

Figure 9:
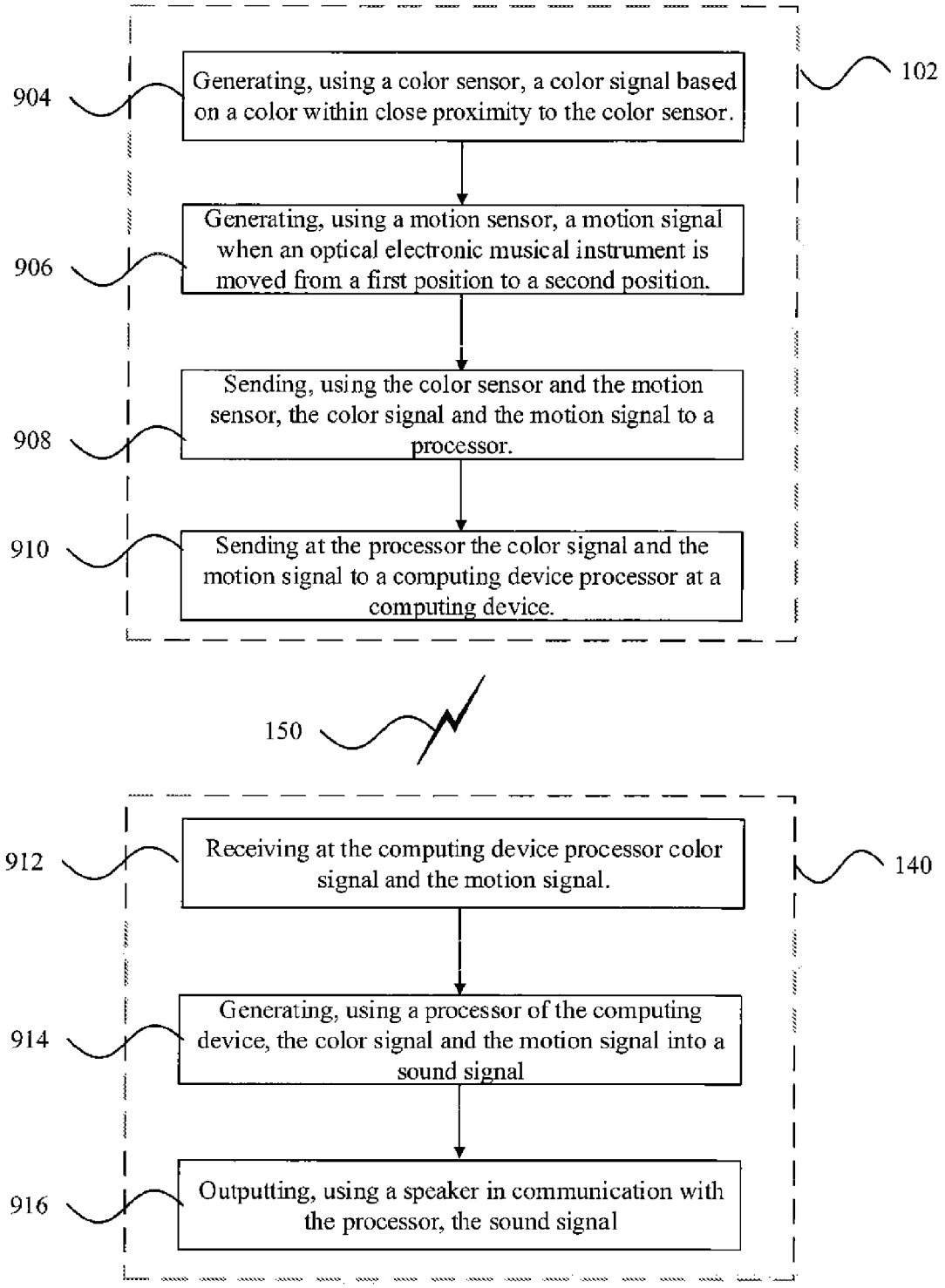
FIG. 9 is a flowchart of a method in accordance with aspects of the present disclosure.

FIG. 9 is a flowchart of an embodiment of the disclosure herein. For instance, referring to e-instrument 102, at step 904 a color signal is generated using a color sensor, the color signal being generated when the color sensor is placed within close proximity to a color. Then, at step 906 a motion sensor generates a motion signal when the motion sensor of the e-instrument is moved from a first position to a second position. From here, the color sensor and motion sensor send their respective signals to a processor at step 908. At step 910, the processor sends the color signal and motion signal over communication link 150 to a computing device processor at computing device 140. At step 912, computing device processor receives the color signal and motion signal. At step 914, the computing device processor generates a sound signal based on the color signal and motion signal. Finally, at step 916 a speaker in communication with the computing device processor outputs the sound signal.

Figure 10:
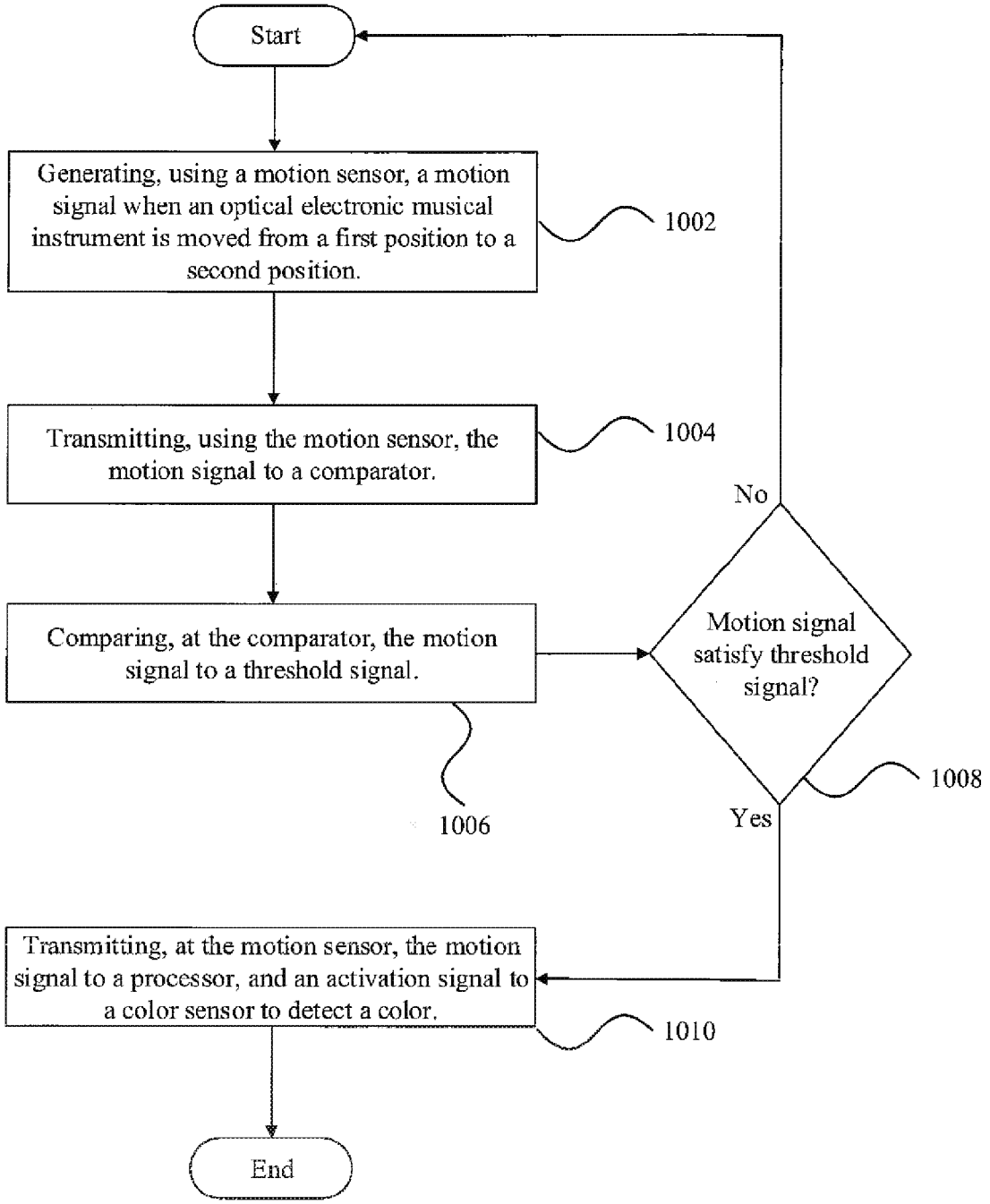
FIG. 10 is a flowchart of a method including a high-pass filter in accordance with aspects of the present disclosure.

FIG. 10 is a flowchart of the implementation of the high-pass filter as disclosed herein. For example, at step 1002 a motion sensor generates a motion signal in response to e-instrument 102 moving from a first position to a second position. At step 1004, the motion sensor transmits the motion signal to a comparator. At step 1006, the comparator compares the motion signal to a threshold signal. The threshold signal may be a hardwired pre-determined threshold that filters any unwanted noise. Step 1008 determines whether the motion signal satisfies the threshold signal or not. If the motion signal does not satisfy the threshold signal, then the process moves back to start. If the motion signal does satisfy the threshold signal, such as by meeting or exceeding the threshold signal, then the process moves on to step 1010. At step 1010, the motion signal is transmitted to a processor and an activation signal is sent to a color sensor to detect a color.

It should be understood that although e-instrument 102 communicates with other computing devices or speakers to process, generate, and output the sound signal, e-instrument 102 should not be restricted thereto. For example, e-instrument 102 may include all of the necessary components to generate, process, and output sound signals. Alternatively, the various processors and speakers may be remote from e-instrument 102. Even further, e-instrument 102 may generate the sound signal locally, and then transmit the generated sound signal to a speaker, using a wire or wirelessly, in which the speaker may then output the sound signal. Other variations of the components and where various signals are generated and output are possible as well.

As a further embodiment, e-instrument 102 may operate without a motion signal, and thereby without a motion sensor. For instance, motion sensor 112 generates the motion signal to influence a level of volume of the sound signal and output sound. In this regard, e-instrument 102 may operate without the presence and use of motion sensor 112, in which case every sound signal generated will be at the same level of volume. Additionally, the user may manually adjust what volume level, pitch level, etc. that they want each sound to be output, such as using a dial or other input device.

As another embodiment, instead of employing a motion sensor to generate the motion signal that may affect the volume level of the sound signal, a microphone may be implemented instead of or in addition to the motion sensor. For instance, the microphone may be positioned on the e-instrument and listens to sound that is emitted from the user tapping the e-instrument against the surface. By the microphone detecting the sound emitted from the e-instrument coming into contact with the surface, the e-instrument can determine that the e-instrument has been used and how much force was used. For instance, by the microphone detecting a tap, the microphone may create a detection signal that is sent to a processor, either local or remote from the e-instrument, which then determines that the user has used the e-instrument and thereby creates a sound signal based on a color signal that was detected by the color sensor as well. Alternatively, if no detection signal was generated by the microphone, then the e-instrument is able to determine that there was no tap. As a further example, based on the volume of the emitted tap, the generated detection signal may influence the volume of the sound signal generated by the processor. For instance, the louder the detected tap by the microphone, the higher the volume the sound signal may be. In addition, the softer the detected tap by the microphone, the lower the volume the sound signal may be.

As another example, the tap sound detected by the microphone may also be used to identify the type of surface or a change in surface that was tapped. For instance, the microphone may listen to a first surface that e-instrument 102 is tapped against, and then identify that a new surface is tapped when a second surface is tapped by e-instrument 102. For instance, one surface may be a wood table, and another surface may be a piece of clothing, such as jeans. In this regard, the e-instrument may have an additional function as changing the generated sound signal based on the surface that the user tapped. Thus, if one type of surface is tapped a first sound signal may be generated, and if a different surface is tapped then a second sound signal different from the first sound signal may be generated.

As a further example, motion sensor 112 and microphone may be used in tandem, or simultaneously, with each other. For instance, if a sound emitted from a tap of e-instrument 102 is undetectable by motion sensor 112 because the user moved e-instrument 102 too slowly, then the detection signal picked up by the microphone may be used to influence the sound signal generated by the processor instead. Alternatively or in addition, the processor may receive and process both the motion signal from the motion sensor and the detection signal from the microphone to develop the sound signal. In this regard, the processor may analyze both signals and determine which one is more accurate, or perhaps use both in generating the sound signal, such as an average volume of both.

As a further embodiment, a force sensor resistor, or just force sensor, may be implemented in addition to or as an alternative to the motion sensor or microphone. The force sensor may vary its resistance depending on how much pressure is being applied to the sensing area. For instance, as one example the force sensing resistor may include a conductive polymer that measures an amount of force or pressure when force is applied to a surface film of the conductive polymer. The harder the force, the lower the resistance, and the weaker the force, the greater the resistance. As one example of a force sensor resistor, its resistance will be larger than 1MΩ, with full pressure applied the resistance will be 2.5 kΩ. The force sensor resistor can also be utilized to turn the e-instrument on and off by applying a preset amount of pressure.

E-instrument 102 may include a pad around the color sensor, and the force sensor generates an impact signal based on the amount of force or impact exerted against the pad. In order for the force sensor to detect impact, there may be some pressure exerted against the pad, which is then detected and the impact signal is generated as a result. The impact signal may then be sent to the processor, which is either local or remote from e-instrument 102, to generate a sound signal based on the impact signal and color signal. The impact signal may influence the volume of the sound signal, such as the greater the impact the higher the volume of the sound signal, and the lesser the impact signal the lower the volume of the sound signal. In addition, the force sensor may be used as an alternative to or in addition to the motion sensor, microphone, or any combination thereof. For instance, the force sensor and motion sensor may be implemented and not the microphone, or the force sensor and microphone may be implemented, and not the motion sensor, and any other combination. Alternatively, any of the three sensors may be used alone. If more than one the three sensors are used, then the processor may generate the sound signal by taking into consideration multiple signals developed.

As a further embodiment, the motion sensor may include an orientation sensor, such as a gyroscope, that generates a position signal that adjusts various settings or characteristics of the system. For instance, the orientation sensor may adjust, as one example of a characteristic, the volume of an outputted sound signal, the type of instrument, the type of notes, etc. For instance, if a user rotates e-instrument 102 clockwise, then the volume outputted by the speaker may increase. Conversely, if the user rotates e-instrument counter-clockwise, then the volume outputted by the speaker may decrease. These adjustments may occur as a result of a change in a position signal that is generated and then sent to the processor that is in communication with the speaker. For example, the orientation sensor may continually measure positioning and thereby measure and then transmit changes in position. As a further example, e-instrument 102 may be moved in a horizontal manner, such as left to right and right to left, in which case the user can switch through a variety of instruments. For instance, if e-instrument 102 is set to drums, then by swiping from right to left with the e-instrument then the generated position signal may be sent to the processor, which changes the instrument to a piano sound. Moving from right to left again may further change the instrument, such as to a guitar sound. In addition, moving from left to right may revert back to another setting, such as back to the piano sound or the drum sound. Any directional movement may adjust the settings, such as diagonal, vertical, or even combinations. For instance, moving from up to down and then to the right may have a particular effect, such as turning on or off the device. Alternatively, moving in combinations may adjust volume, instruments, tone, etc.

As another embodiment, the orientation sensor may be implemented to create a more accurate color signal. For instance, the changes of the position signal generated by the orientation sensor may identify that a user came within close proximity to a surface at a poor angle, such that the color sensor is not positioned directly over a surface to identify the color. In this situation, the color signal generated by the color sensor may not be fully accurate since the color sensor identified the color at an angle. When the position signal identifies that the e-instrument was positioned at an angle over the surface, then the processor may take the position signal into consideration when using the color signal generated by the color sensor. For instance, the processor may decide to amplify the color or change the color of the color signal since the processor knows that the color sensor identified the color at a poor angle. In this regard and for example, if color sensor detects a dark red color and the orientation sensor identifies that a poor angle was employed, then the processor may change the dark red to a lighter red, such as a typical red, because if a proper angle was used then the identified color may have been a lighter shade.

Advantages of the optical electronic musical instrument described herein allows users to generate music with a portable and cost-effective device. For instance, e-instrument 102 may cost less than a drum set, piano, violin etc. In addition, musical instruments such as drum sets and pianos can be clunky and difficult to carry or transport, such that wherever the instrument is located may be the only feasible location that a group of people can congregate to play or listen to music. Conversely, a user can bring e-instrument 102 wherever they want and even carry it in their pocket. The user may simply need to carry around his or her smart phone to receive various signals, and then process and output the sound signals accordingly. As discussed above, however, e-instrument 102 may be configured to perform all or part of the necessary processing and outputting sounds locally, remotely, or any combination of the two. Furthermore, e-instrument 102 can aid users in learning music, playing instruments, and developing his or her talents. For example, musicians can use e-instrument 102 as a performance tool for public displays, or developing music. Musicians may not be able to carry music equipment around all the time and in all places, by using e-instrument 102 musicians can continue to develop and create music, beats, rhythms, etc. at any possible location and time.

In addition, e-instrument 102 may be advantageous as a learning tool for toddlers. For example, particular sounds may be correlated with particular colors, and in this regard toddlers can receive feedback when they tap on the proper color that they want to identify. For instance, the generated sound signal may be a voice recording of particular colors, such as "red," "green," "orange," etc. Thus, when a toddler taps on a particular color, they are able to reinforce their understanding by also hearing the color being outputted by the speaker. Additionally, e-instrument 102 may be used as a playful tool for children and adults of all ages.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

The invention claimed is:

1. An optical electronic musical instrument, comprising:

a processor;

a color sensor connected to the processor and configured to generate a color signal based on a color within close proximity to the color sensor; and a motion sensor connected to the processor and configured to generate a motion signal when the optical electronic musical instrument is moved from a first position to a second position;

receive at the processor the color signal and the motion signal;

transmit at the processor the color signal and the motion signal to a computing device processor, wherein the computing device processor is associated with a computing device; and generate or retrieve at the computing device processor a sound signal based on the color signal and the motion signal.

2. The optical electronic musical instrument of claim 1, wherein the motion signal is based on a detected rate of acceleration of the optical electronic musical instrument moving from the first position to the second position.

3. The optical electronic musical instrument of claim 2, wherein a volume of the sound signal depends on the motion signal.

4. The optical electronic musical instrument of claim wherein the computing device further comprises:

memory connected to the computing device processor; and a speaker connected to the computing device processor;

wherein the computing device processor transmits the sound signal to the speaker and the speaker is configured to output the sound signal.

5. The optical electronic musical instrument of claim 4, wherein the computing device is a smart phone, tablet, laptop computer, desktop computer, or a portable speaker.

6. The optical electronic musical instrument of claim 1, further comprising generating a numerical value associated with the color signal, comparing the numerical value with a threshold color value, and either storing the color signal or not storing the color signal based on the comparison of the numerical value with the threshold color value.

7. The optical electronic musical instrument of claim 1, wherein the optical electronic musical instrument is contained within a device shaped as a drumstick.

8. The optical electronic musical instrument of claim 1, wherein the motion sensor includes an orientation sensor, the orientation sensor configured to detect a change of orientation of the optical electronic musical instrument, the change of orientation causing an adjustment of a characteristic of the sound signal or the optical electronic musical instrument.

9. The optical electronic musical instrument of claim 1, wherein the optical electronic musical instrument is contained in a device shaped as a ring-shaped apparatus configured to be placed around a finger of a user.

10. The optical electronic musical instrument of claim 9, wherein the ring-shaped apparatus defines a hole that exposes at least a portion of the color sensor.

11. A method, comprising:

generating by a motion sensor a motion signal when an optical electronic musical instrument is moved from a first position to a second position;

generating by a color sensor a color signal based on a color within close proximity to the color sensor;

receiving the color signal and the motion signal at a processor; and generating or receiving by the processor a sound signal based on the color signal and motion signal.

12. The method of claim 11, wherein the motion signal is based on a detected rate of acceleration of the optical electronic musical instrument moving from the first position to the second position.

13. The method of claim 12, wherein a volume of the sound signal depends on the motion signal.

14. The method of claim 11, further comprising:

receiving at a speaker the sound signal from the processor; and outputting at the speaker an audible sound based on the sound signal.

15. The method of claim 11, further comprising:

receiving at a computing device using a computing device processor the sound signal from the processor; and outputting by a speaker connected to the computing device processor the sound signal.

16. The method of claim 11, further comprising a filter with a threshold signal, wherein the filter compares the motion signal to the threshold signal to determine whether the motion signal signifies an intentional use of the optical electronic musical instrument by a user.

17. The method of claim 11, the motion sensor includes one or more of at least one accelerometer and at least one gyroscope.

18. The method of claim 11, further comprising:

detecting by an orientation sensor a change of orientation of the optical electronic musical instrument; and adjusting by the processor and based on the change of orientation a characteristic of the sound signal or the optical electronic musical instrument.

* * * * *